US005263652A

United States Patent [19]

Iwanami et al.

[11] Patent Number: 5,263,652

[45] Date of Patent: Nov. 23, 1993

[54] FLUIDIZED CRUSHER/DRIER FOR USE IN A FLUIDIZED CRUSHING/DRYING SYSTEM

[75] Inventors: Sadao Iwanami, Mitaka; Fukutaro Kataoka, 39-20, Yanagimachi, Saiwai-ku, Kawasaki-shi, Kanagawa-ken, both of Japan

[73] Assignee: Fukutaro Kataoka, Kawasaki, Japan

[21] Appl. No.: 784,233

[22] Filed: Oct. 30, 1991

[30] Foreign Application Priority Data

Oct. 30, 1990 [JP] Japan ..... 2-293147
Mar. 22, 1991 [JP] Japan ..... 3-83259

[51] Int. Cl.[5] ..... B02C 11/08; B02C 23/40

[52] U.S. Cl. ..... 241/57; 241/65; 241/79.1; 241/285.3; 241/292.1

[58] Field of Search ..... 241/57, 65, 79.1, 80, 241/242, 285.3, 292.1

[56] References Cited

U.S. PATENT DOCUMENTS 2,363,282 11/1944 Arnold ..... 241/65 X
2,592,231 4/1952 Allstott ..... 241/65 X
2,662,694 12/1953 Lotz ..... 241/65 X
3,794,251 2/1974 Williams ..... 241/65
4,037,795 7/1977 Fyfe ..... 241/79.1 X
4,037,796 7/1977 Francis ..... 241/79.1 X
4,385,732 5/1983 Williams ..... 241/285.3 X
4,557,421 12/1985 Probst et al. ..... 241/285.3 X
4,566,639 1/1986 Williams ..... 241/57 X
4,982,905 1/1991 Holsiepe et al. ..... 241/79.1

FOREIGN PATENT DOCUMENTS 609228 11/1979 Japan ..... 241/57

*Primary Examiner*—Eugenia Jones
*Assistant Examiner*—Raymond D. Woods
*Attorney, Agent, or Firm*—Nikaido, Marmelstein, Murray & Oram

[57] ABSTRACT

A fluidized crusher/drier for use in a fluidized crushing/drying system includes: a generally tower-shaped housing; a product discharge outlet provided in the ceiling of the housing; a material supply inlet provided in a lower portion of a housing wall for supplying industrial waste therethrough; a chute surface defining part of the housing wall extending downward from the material supply inlet to the bottom of the housing; at least one hot blast inlet provided in a lower portion of the housing wall for supplying hot blast; an arcuate bottom surface having an arcuate cross section and defining the bottom of the housing; and a single crusher vane wheel provided near the arcuate bottom surface of the housing for rotation along the arcuate bottom surface while maintaining a slight distance from it.

4 Claims, 2 Drawing Sheets

FLUIDIZED CRUSHER/DRIER FOR USE IN A FLUIDIZED CRUSHING/DRYING SYSTEM

BACKGROUND OF THE INVENTION

1. Field of the Invention

This invention relates to a fluidized crusher/drier for use in a fluidized crushing/drying system for crushing industrial waste, in particular, moisture-containing industrial waste, then exposing it to high-speed hot blast, and finally recovering it in the form of dried particles or powder.

2. Prior Art

A patent publication of Japanese Patent No. 1290498 discloses a fluidized crusher/drier for use in a fluidized crushing/drying system. The prior art crusher/drier includes a tower-shaped housing, a product discharge outlet at the top of the housing for communication with a product recovery unit through a duct, a material inlet provided at a lower portion of the housing for entry of industrial waste or the like (hereinafter called a material) to be treated, a hot blast inlet provided at a lower portion of the housing, and two crusher vane wheels provided along the bottom of the housing for rotation in opposite directions.

Pulverization of a material by using the prior art fluidized crusher/drier is performed as follows: The material is continuously supplied through the material inlet onto the vane wheels, and it is broken from a large mass into small masses or lumps while blowing hot blast thereto. Such small masses or lumps are repelled upward by crusher vanes of the crusher vane wheels and are recrushed into small lumps, grains or particles due to collision between them. Meanwhile, moisture evaporates from the material, and dried particles or powder are conveyed upward by air flow supplied for drying purposes. Semi-treated part of the material still in the form of coarse wet lumps, masses or grains that have failed to ride on the fluidized air flow drop onto the vane wheels and again undergo the same treatment. By repeating this procedure, the material is finally crushed into particles or powder which are fine enough to ride on and move up with ascending air flow caused by hot blast blown into the fluidized crusher/drier. The particles and powder are discharged through the product discharge outlet and the duct, and are recovered by the recovery unit.

The prior art fluidized crusher/drier, however, is not satisfactory in efficiency of pulverization, due to various problems explained below.

Namely, it uses two crusher vane wheels. The use of two crusher vane wheels invites an interference loss.

Semi-treated part of the material in the form of lumps, grains or particles still having large apparent specific gravities and metal scraps or other debris contained in the material which have been repelled at a high speed to an upper portion of the housing by the crusher vane wheels often fail to fall onto the crusher vane wheels, but run to the discharge outlet at the ceiling and enter in the recovery unit through the duct.

The material crushed into lumps or grains and repelled by the crusher vane wheels may hit and damage bearings of the crusher vane wheels and their adjacent wall surfaces. Moreover, relatively small grains or particles may be blown to the exterior through gaps around the bearings received in bores in the housing wall.

Some of coarse grains or particles that have failed to ascend together with the air flow may remain under the crusher vane wheels and increase the load to the crusher vane wheels, which necessarily increases the power. In particular, pebbles, nails, staples or other debris contained in the material supplied to the fluidized crusher/drier are apt to remain around the lower halves of the crusher vane wheels, and they often engage between the crusher vanes of the crusher vane wheels and the bottom surface. Then they damage vanes of the crusher vane wheels or increase the load to the crusher vane wheels.

Such increase in load to the crusher vane wheels, in turn, increases the load to the drive source, and may accidentally interrupt rotation of the crusher vane wheels. When such a trouble occurs, it is necessary to stop the operation to remove the debris. However, interruption of operation causes all the material under crushing treatment to accumulate on the bottom surface and on the crusher vane wheels, and the debris must be removed under such a bad condition. Therefore, much time and labor are required for removal of debris.

OBJECTS OF THE INVENTION

It is therefore an object of the invention to provide a fluidized crusher/drier for use in a fluidized crushing/drying system that can efficiently crush a material supplied, and treat the crushed material into particles or powder to be recovered.

Another object of the invention is to provide a fluidized crusher/drier that is operative with only one crusher vane wheel.

Another object of the invention is to provide a fluidized crusher/drier that prevents insufficiently treated part of industrial waste from accidentally entering in a product recovery unit.

Another object of the invention is to provide a fluidized crusher/drier that prevents the material repelled by the crusher vane wheel from hitting and damaging a bearing of the crusher vane wheel and prevents the material from exiting to the exterior through a bore receiving the bearing therein.

Another object of the invention is to provide a fluidized crusher/drier which prevents pebbles, nails, staples and other debris from remaining on a bottom surface under the crusher vane wheel.

SUMMARY OF THE INVENTION

A basic arrangement of fluidized crusher/drier for use in a fluidized crushing/drying system according to the invention includes: a generally tower-shaped housing having vertically extending wall means, a ceiling, and a bottom; a product discharge outlet provided in the ceiling of the housing; a material supply inlet provided in a lower portion of the wall means for supplying industrial waste therethrough; a chute surface defining part of the wall means and sloping down from the material supply inlet to the bottom of the housing at least one hot blast inlet provided in a lower portion of the wall means for supplying hot blast therethrough; an arcuate bottom surface having an arcuate cross section and defining the bottom of the housing; and a single crusher vane wheel provided near the arcuate bottom surface of the housing for rotation along the arcuate bottom surface with a slight distance therefrom.

A material continuously supplied from the material inlet slides down the chute surface onto the crusher vane wheel. The material often in the form of large masses is then broken into small masses or lumps by crusher vane wheel to which hot blast is blown. Such lumps or masses are repelled toward the chute surface of the housing by centrifugal force of the crusher vane wheel, and hit a material that is newly supplied through the material inlet and slides down the chute surface. As a result, the newly supplied material is also broken into small masses or lumps partly by the repelled masses or lumps and partly by the crusher vane wheel 4. Meanwhile, part of the material crushed into minute lumps or masses and are pulled into the crusher vane wheel in rotation along the arcuate bottom surface. The material is here grind-crushed into dried grains or particles. While this procedure is repeated, the material is finally crushed into dried particles or powder fine enough to float above in the housing. Since this fluidized crusher/-drier has only one crusher vane wheel, driving mechanism can be simplified, and the space therefor can be reduced. If two or more hot blast inlets are provided in different levels, the degrees of pulverization and dryness of finally obtained particles or powder can be adjusted by controlling the amounts of air supply from the respective hot blast inlets.

In a specific aspect of the invention, the crusher vane wheel is made of a rotary shaft driven by a power source, center plates secured on the rotary shaft, bosses secured on the rotary shaft on opposite surfaces of the center plates, and crusher vanes secured to the center plates and the bosses, respectively. At opposite end portions of the rotary shaft are provided suction vane wheels having suction vanes for rotation to generate axial flows toward the center plates. Because of the unique design of the crusher vane wheel and the suction vane wheels, inward axial flows toward the crusher vane wheel are generated by the suction vane wheel, and they pull small masses, lumps or grains of the material into the vane wheel. As a result, the material does not hit and damage the bearings and the housing wall around the bearings. It is also prevented that the material adheres or accumulates on these portions, and leaks to the exterior through the bearing holes or clogs the bearings. Repelling the material by the crusher vane wheel and pulling it back to the crusher van wheel from the suction vane wheel are repeated circularly, and the material is finally crushed into desired dried fine particles or grains.

In another specific aspect of the invention, the arcuate bottom surface of the housing is formed as an openable bottom plate which is pivotally supported and driven by a bottom plate driving mechanism to open or close the bottom of the housing. This arrangement prevents metal scraps, pebbles or other debris contained in the material from remaining under the crusher vane wheel and accidentally locking the crusher vane wheel due to excessive load thereto.

In another specific aspect of the invention, a debris recovery box having an air blow inlet is provided under the bottom of the housing. Relatively high-pressure air is supplied from the air blow inlet into the debris recovery box to adjust the air pressure therein slightly higher than that in the housing, so that only debris having relatively high gravities enters in the debris recovery box but the material itself treated into grains, particles or powder cannot enter in it.

In another aspect of the invention, a damper is provided at an upper portion in the housing and vertically pivoted by a damper driving mechanism. When the damper is pivoted to extend horizontally within the housing, it prevents that semi-treated material, metal scraps, pebbles and other debris repelled upward by the crusher vane wheel run up beyond the damper toward the product discharge outlet.

Other details and features of the invention will be apparent from the description given below by way of a preferred embodiment with reference to the accompanying drawings.

DESCRIPTION OF A PREFERRED EMBODIMENT

Figure 1:
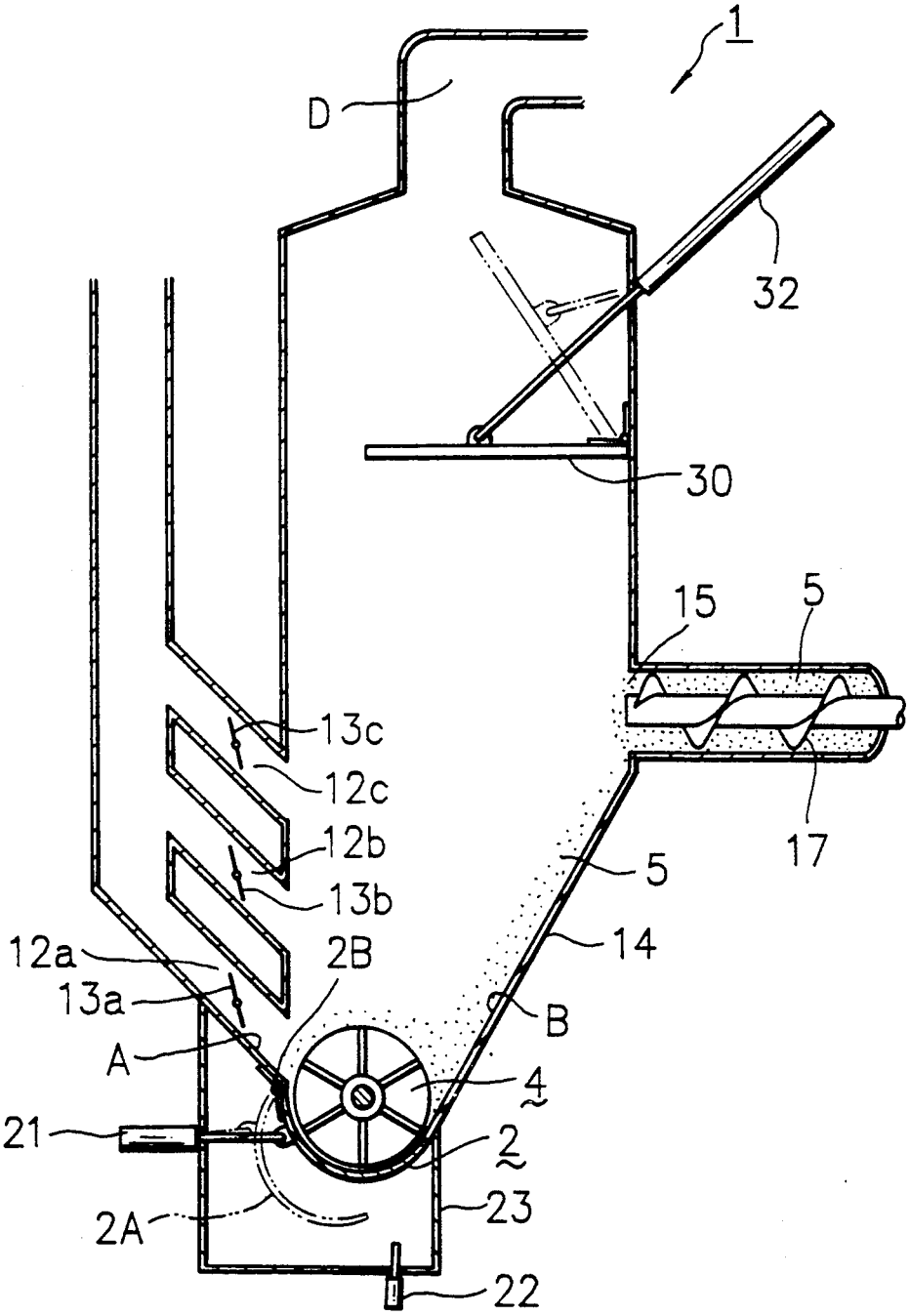
FIG. 1 is a vertical cross-sectional view of a fluidized crusher/drier embodying the invention.

In FIG. 1 which is a vertical cross-sectional view of the entirety of a fluidized crusher/drier embodying the invention. The fluidized crusher/drier is to be incorporated into a fluidized crushing/drying system together with a material supply unit for supplying industrial waste or other material to be treated, a hot blast supply unit for supplying hot blast, a product recovery unit for recovering products obtained by crushing and drying a material into particles or powder, vane wheel driving units, and other associated units (neither shown).

In the same figure, a housing 1 of the fluidized crusher/drier has an arcuate bottom surface 2 behaving as a grind-crushing portion. The arcuate bottom surface 2 is a gutter-shaped cavity having an arcuate cross section. Its width is slightly larger than the diameter of a crusher vane wheel 4, and its depth is slightly shallower than the radius of the crusher vane wheel 4. The cavity receives the crusher vane wheel 4 and permits it to rotate with a slight distance from the bottom surface 2 with power from a vane wheel driving unit (not shown).

Figure 2:
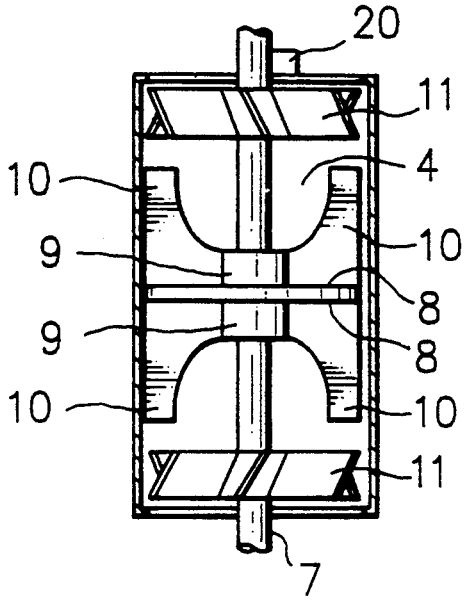
FIG. 2 is a horizontal cross sectional view of the fluidized crusher/drier with a plan view of vane wheels.
Figure 3:
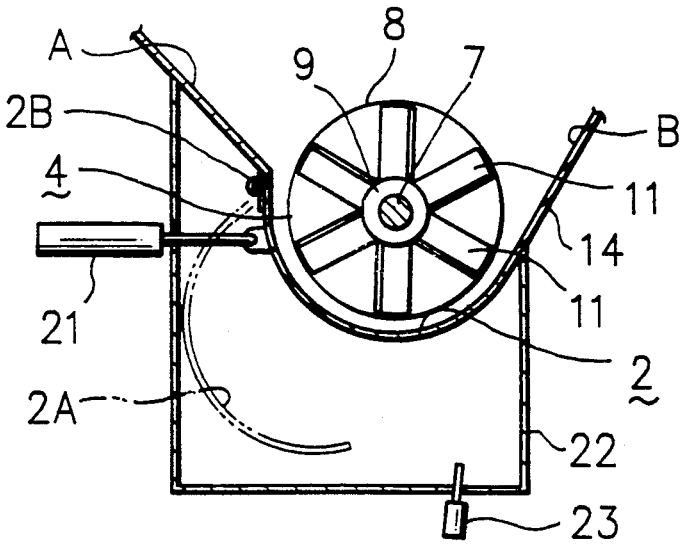
FIG. 3 is a fragmentary enlarged cross sectional view of the fluidized crusher/drier of FIG. 1.

The crusher vane wheel 4, as best shown in FIGS. 2 and 3, consists of center plates 8—8 secured back to back on a rotary shaft 7, bosses 9—9 mounted on the rotary shaft and fit to the center plates 8—8, and crusher vanes 10—10 secured to the bosses 9—9 and the center plates 8— 8, respectively. On opposite end portions of the rotary shaft 7 are secured suction vane wheels 11—11 for forcibly generating inward axial flows.

Opposite ends of the rotary shaft 7 are rotationally supported by bearings (not shown) provided in lower portions of opposite side walls of the housing 1. The crusher vane wheel 4 is configured to be rotatable in the counterclockwise direction as shown in FIG. 1. As a result, one side of the grind-crushing portion 2 behaves as a suction side A whereas the opposite side of the grind-crushing portion 2 behaves as a discharge side B. Above the suction side A are provided hot blast inlets **12*a*, 12*b* and 12*c* in different levels. Dampers 13*a*, 13*b* and 13*c* are provided in the hot blast inlets 12*a*, 12*b* and 12*c*, respectively, to control the amount of hot blast to be blown into the housing 1. The dampers 13*a*, 13*b* and 13*c* may be controlled by detecting the speed of rotation of the crusher vane wheel which varies with load to the crusher vane wheel 4 during crushing operation of a material supplied thereon. The discharge side B of the grind-crushing portion 2 is continuous to a chute surface 14 which extends in the form of a steep slope terminating at a material inlet 15, so that industrial waste or other material supplied through the material inlet 15 slides down along the chute surface 14 onto the crusher vane wheel 4. A screw conveyor 17 is provided in the material inlet 15 for continuously transporting a material into the housing 1**.

A damper 30 is provided near the ceiling of the housing 1 for preventing that metal scraps, pebbles and other debris contained in the material and repelled upward by rotational force of the crusher vane wheel 4 enter in a product recovery unit through the product discharge outlet D provided at the top of the housing 1 and a duct connecting the product discharge outlet to the product recovery unit (not shown). The damper 30 has an area smaller than the cross-sectional area of the housing 1 at the level where the damper 30 is located, and an ascending air flow path is defined between the opposed wall of the housing 1 and the outer margin of the damper 30 even when the damper is pivoted downward to extend horizontally. The proximal end of the damper 30 is supported for up and down pivotal movements by a hinge at a position of the wall of the housing 1 above the material inlet 15 and below the ceiling of the housing 1.

A damper driving mechanism 32 is provided on the side wall of the housing 1 to rotate the damper 30 upward or downward. The illustrated example of the damper driving mechanism 32 is a cylinder having a cylinder rod whose proximal end is pivotally supported on a stationary fixture portion and whose distal end is pivotally coupled to the damper 30 so that contraction of the cylinder causes an upward movement of the damper 30 whereas extension thereof causes a downward movement of the damper 30. The cylinder may be driven either automatically or manually.

A load detector 20 is attached to the rotary shaft 7 of the crusher vane wheel 4 or one of the bearings in order to detect the load applied to the crusher vane wheel 4 and output a detection signal when the load exceeds a predetermined value.

The grind-crushing portion 2 defining the bottom of the housing 1 of the fluidized crusher/drier is made of an openable bottom plate 2A which opens and closes the bottom of the housing 1. The openable bottom plate 2A is pivotally supported at lower end of the housing wall by a hinge 2B and opens the bottom 2 of the housing 1 when pivoted downward as best shown in FIG. 3. When it is in the closed position, the bottom 2 is shaped into the arcuate bottom surface 2 wider than the diameter and shallower than the radius of the crusher vane wheel 4.

A bottom plate driving mechanism 21 is provided to selectively drive the openable bottom plate 2A to the opened and closed positions. The illustrated embodiment uses an air cylinder as the mechanism 21. The air cylinder has a rod whose proximal end is pivotally attached to a stationary member and whose distal end is pivotally attached to the lower surface of the openable bottom plate 2A. Contraction of the air cylinder brings the openable bottom plate 2A to the opened position, and extension thereof brings it to the closed position. The air cylinder is actuated by a signal produced by the load detector 20 when it detects any excessive load to the crusher vane wheel 4 caused by the presence of debris. Excessive load to the crusher vane wheel 4 may be known by detecting excessive load to the driving system of the crusher vane wheel 4, and a result of the detection may be used to activate the bottom plate driving mechanism. This mechanism is not restricted to the air cylinder, but may be a hydraulic cylinder or a combination of motor, crank mechanism, and so on.

Crushing and drying treatment of a material into particles or powder using the fluidized crusher/drier described above is performed as explained below.

First, all associated units such as material supply unit, hot blast supply unit, vane wheel driving units, product recovery unit (neither shown) are activated, then a pre-treated material 5 supplied through the material inlet 15 slides down the chute surface 14 to an upper portion of the discharge side B of the currently rotating crusher vane wheel 4. On the other hand, hot blast necessary for drying the material 5 is supplied from the lowest hot blast inlet **12*a* in a direction pulled into the crusher vane wheel 4 located above the grind-crushing portion 2. In this condition, the material falling onto the crusher vane wheel 4 is broken into lumps or masses by an impulsive force caused by collision with the crusher vane wheel 4 which is rotating in the counterclockwise direction. Some of these lumps or masses of the material are repelled toward the chute surface 14 by centrifugal force caused by rotation of the crusher vane wheel 4**. Repelled lumps or masses of the material hit a subsequently supplied material and break it into lumps or masses. This aspect of crushing operation is hereinafter called crushing by collision.

Some of lumps or masses are pulled toward the suction side A of the grind-crushing portion 2 due to an air flow produced by rotation of the crusher vane wheel 4. The lumps or masses pulled here are exposed to the hot blast to remove moisture therefrom and are grind-crushed into grains or particles in the grind-crushing portion 2. This aspect of crushing operation is hereinafter called grind-crushing.

While crushing by collision and grind-crushing are repeated in combination with drying operation, the material is finally crushed or ground into dried grains, particles or powder. In this process, hot blast blown toward the grind-crushing portion 2 and rotation of the crusher vane wheel 4 cause an ascending air current, and the treated material in the form of grains, particles or power is blown upward in the housing 1 by the ascending air current. Part of the material well treated into particles or powder fine and dry enough to ride on the ascending air current floats in the housing 1. However, part of the material, still having the form of too coarse pieces to ride on the ascending air, drops therefrom to the grind-crushing portion 2 to again undergo the grind-crushing treatment by the crusher vane wheel 4. Finally, it is also treated into particles or powder fine enough to ride on the ascending air.

The material fully treated into particles or powder fine enough to float in the housing 2 is discharged from the product discharge outlet at the top of the housing 1 and guided by the duct into the product recovery unit (not shown).

In the illustrated embodiment, further hot blast inlets **12*b* and 12*c* are provided in different levels above the hot blast inlet 12*a***.

If entry of hot blast through the upper hot blast inlets **12*b* and 12*c* is restricted or stopped by controlling their dampers 13*b* and 13*c* while a large amount of hot blast through the lower hot blast inlet 12*a* is permitted to enter toward the grind-crushing portion 2 by fully opening it, a strong ascending air current is generated, and relatively heavy crushed material also rides on the ascending air and floats in the housing 1**.

Therefore, in order to treat the material into sufficiently fine particles, the amount of hot blast from the lower hot blast inlet 12*a* is decreased by controlling its damper 13*a* so that semi-treated material falls onto the grind-crushing portion 2 for repeated grind-crushing treatment until it is fully treated into sufficiently fine particles or powder.

It is also possible to adjust the amount of hot blast from the lower hot blast inlet 12*a* toward the grind-crushing portion 2 and adjust open amounts of the upper hot blast inlets 12*b* and 12*c* by controlling by their dampers 13*b* and 13*c* so as to supply an amount of hot blast to compensate the reduced amount of the hot blast inlet 12*a*. By this operation, viscosity of fine particles can be adjusted.

The prior art fluidized crusher/drier involved such a drawback that crushed masses of the material, pebbles and metal scraps contained in the material are repelled by crusher vane wheels to opposite sides thereof and damage bearings and their adjacent housing wall. The suction vane wheels 11—11 used in the invention remove this problem. That is, suction vane wheels 11—11 are provided at opposite sides of the crusher vane wheel 4 to continuously generate axial air flows toward the center plates 8—8 of the crusher vane wheel 4 during crushing operation of a material. Therefore, the material crushed into masses or lumps by the crusher vane wheel 4 as well as pebbles, metal scraps, etc. contained in the material are prevented from reaching the bearings and the housing wall around them because of the axial air flows. Instead, they are forcibly pulled toward the center plates 8—8 and are repelled up by the center plates 8—8 and blown up by the ascending air current.

In the event that metal scraps, pebbles or the like contained in the material are repelled upward by rotational force of the crusher vane wheel 4, it is necessary to block them. In this case, the damper 30 is pivoted down by operating the damper driving mechanism 32, i.e., the cylinder, so as to stop further upward movements of the repelled metal scraps, pebbles, etc. and prevent them from reaching the product discharge outlet. In this case, since the damper 30 has an area smaller than the cross sectional area of the housing, it does not block the path of the ascending air and does not prevent recovery of well-treated particles and powder.

When pebbles, metal scraps and other debris remain and accumulate on the grind-crushing portion 2 or around the crusher vane wheel 4, the load to the vane wheel 4 or to the vane wheel driving mechanism increases. The detector 20 detects such increase in load, and issues a signal. The bottom plate driving mechanism 21 receives the signal and drives the air cylinder to rotate the openable bottom plate 2A to the opened position. Thereby, these debris are discharged from the interior of the housing 1 into the debris recovery box 22 located under the bottom plate 2A. The debris recovery box 22 has the air inlet 23 which supplies air to the debris recovery box 22 to maintain the air pressure in the debris recovery box 22 slightly higher than that in the housing 1. Therefore, the material crushed into fine particles are pushed back toward the crusher vane wheel 4 and cannot fall into the debris recovery box 22 even when the bottom plate 2A is in the open position. That is, only heavy pebbles, metal scraps and other debris fall into the debris recovery box 22 against the relatively high air pressure therein.

The fluidized crusher/drier according to the invention may also be used for recovery of molding sand, which is one of industrial waste, by adjusting amounts and temperature of hot blast blown through the hot blast inlets.

In this case, the material is masses, blocks or lumps of sand obtained by crushing a sand mold by an air hammer or the like. Such a sand mold is formed by shaping and hardening sand into a mold by using an organic binder. For recovery of molding sand, a certain amount of blocks or sand obtained by breaking a sand mold is supplied, in predetermined intervals, through the material inlet 15 to undergo crushing and drying treatment in accordance with the above-mentioned process.

Grains of sand obtained by the crushing operation include organic binder adhered thereto. In order to recover pure sand, the organic binder adhered to each grain must be removed.

Next explanation is directed to how to perform the operation. One of important factors therefor is to adjust the temperature of hot blast blown through the hot blast inlets to maintain a significantly low temperature depending on the nature of the subject to be treated. It is also necessary to adjust the amount of the hot blast to maintain a significantly small amount so that a significantly weak ascending air flow is produced in the housing. As a result, grains of sand do not easily exit to the housing, but are repeatedly drawn to the grind-crushing portion 2. Meanwhile, grains of sand are ground in the grind-crushing portion 2 by the crusher vane wheel 4, which is rotating, until the organic binder peels off.

The organic binder peeled off from grains of sand takes the form of dried fine powder having a very small gravity, floats in the housing, and is discharged to the exterior of the housing 2 by the weak ascending air flow produced in the housing. Then the dried fine powder of the organic binder is recovered by a recovery box (not shown). After the dried fine powder of the organic binder is discharged to the exterior, the amount of hot blast from the hot blast inlets is slightly increased to obtain a slightly stronger ascending air flow in the housing. As a result, the grains of sand free from the organic binder ride on the ascending air and run to the exterior of the housing. Then the sand is also recovered by a recovery box (not shown).

Shown below are results of an experiment for recovery of molding sand by using the fluidized crusher/drier according to the invention.

The crusher vane wheel was first driven at the speed of 40 m/s or more. Then, grains of sand were broken. Next, the crusher vane wheel was driven at the speed of 20 m/s to 40 m/s. Then, favorable results were obtained. These results are shown in the following table in comparison with those of a prior art molding sand recovery system.

TABLE

| Sample | SYSTEM OF THE INVENTION | | | PRIOR ART SYSTEM | | |
|---|---|---|---|---|---|---|
| No. | 1 | 2 | 3 | 4 | 5 | 6 |
| Grind Cycle | 0.8 mins. | continuous supply | 2 mins. | continuous | 2 standard application cycles | 5 repeated standard application cycles |
| Temp. °C. at Grind Inlet | Room Temp. | 400 | 400 | Room Temp. | Room Temp. | Room Temp. |
| Temp. °C. at Grind Outlet | Room Temp. | 146 | 148 | Room Temp. | Room Temp. | Room Temp. |

TABLE-continued

| Sample | SYSTEM OF THE INVENTION | | | PRIOR ART SYSTEM | | |
|---|---|---|---|---|---|---|
| No. | 1 | 2 | 3 | 4 | 5 | 6 |
| Temp. °C. of Recovered Sand | Room Temp. | 140 | 128 | Room Temp. | Room Temp. | Room Temp. |
| Quantity of Remaining Organic Binder | 0.67 | 0.147 | 0.166 | 2.698 | 0.65 | 0.43 |

It is evident from the table that the fluidized crusher/-drier according to the invention can recover qualified sand in a more efficient manner than prior art systems.

The invention has been described above with reference to a specific embodiment. The embodiment, however, should not be construed as limiting the invention thereto. Instead, the invention covers various alterations and modifications without departing from the scope thereof.

What is claimed is:

1. A fluidized crusher/drier disposed in a fluidized crushing/drying system and comprising a housing which includes a ceiling provided with a duct therein, side wall means extending vertically from said ceiling, said side wall means being provided at a lower portion thereof with a material supply inlet and hot blast inlet, and a bottom portion provided at a bottom section of said side wall means, said bottom portion having a crusher vane wheel for crushing a material, wherein a crushing portion for cooperating with said crusher vane wheel to crush said material between said crushing portion and said crusher vane wheel is disposed in said bottom portion, said crushing portion having a width larger than a diameter of said crusher vane wheel, said crushing portion defining a recess having an arcuate section, said recess having a depth smaller than a radius of said crusher vane wheel, and wherein a chute is formed as an angled portion of said side wall means, said chute being disposed between said material supply inlet and said crushing portion such that said material is descended from said material supply inlet to said crushing portion along said chute, and wherein at least one first hot blast inlet is provided opposite a lower portion of said chute and is directed toward said crushing portion, said crusher vane wheel including a rotary shaft supported on side walls of said crushing portion and driven by a power source, center plates secured to said rotary shaft, said center plates having outer surfaces thereon, bosses coaxially fitted on said rotary shaft and located closely adjacent the outer surfaces of said center plates, respectively, and crusher vanes supported on said bosses and said center plates, and wherein suction vane wheels are secured at opposite ends of said rotary shaft for inwardly generating air flow toward said center plates.

2. A fluidized crusher/drier according to claim 1 wherein at least one second hot blast inlet is provided above said at least one first hot blast inlet in a multi-step relationship.

3. A fluidized crusher/drier according to claim 1, wherein said crushing portion is pivotable by a mechanism operating in response to a detector for detecting a load exerted on said crusher vane wheel and a debris recovery box having an air blow inlet is provided under said crushing portion.

4. A fluidized crusher/drier according to claim 1, further including a damper pivotably mounted to said side wall means and a mechanism for vertically moving said damper.

* * * * *